United States Patent [19]

Morrison et al.

[11] 4,031,944

[45] June 28, 1977

[54] DEVICE FOR OPENING AND CLOSING OF CORD OPERATED CLOSURES

[75] Inventors: Howard J. Morrison, Deerfield; Derek A. Brand, Naperville, both of Ill.

[73] Assignee: Marvin Glass & Associates, Chicago, Ill.

[22] Filed: Aug. 11, 1975

[21] Appl. No.: 603,342

[52] U.S. Cl. ..... 160/331; 226/50; 226/186; 254/186 R

[51] Int. Cl.[2] ..... A47H 5/02; B66D 1/76

[58] Field of Search ..... 160/331, 310, 321; 254/175.3, 141, 186 R, 174; 226/50, 186

[56] References Cited

UNITED STATES PATENTS

| | | | |
|---|---|---|---|
| 2,468,453 | 4/1949 | Mallentjer | 160/331 |
| 2,798,194 | 7/1957 | Cantin | 160/331 X |
| 3,155,778 | 11/1964 | Meyer | 226/50 X |
| 3,269,454 | 8/1966 | Gill et al. | 160/331 |
| 3,438,423 | 4/1969 | Melull et al. | 160/331 |
| 3,561,520 | 2/1971 | Gill | 160/331 |

*Primary Examiner*—Philip C. Kannan
*Attorney, Agent, or Firm*—Mason, Kolehmainen, Rathburn & Wyss

[57] ABSTRACT

A device for the opening and closing of cord operated closures, including a unidirectional electric drive motor and a pair of movable idler pulleys. The drive motor drives a frictional drive roller. A pair of flexible cords from the closure are singularly held against the drive roller by moving one or the other of the idler pulleys against the drive roller sandwiching a cord therebetween, one idler pulley causing one cord to move in one direction and the other idler pulley causing the cord to move in the other direction. An automatic shutoff mechanism is incorporated to shut off the drive motor and release the cord when sufficient tension is present on the cord, for instance, at the end of closure travel. The shutoff mechanism causes the drive roller and associated mechanism to travel along the cord a short distance thereby triggering a latch release mechanism.

20 Claims, 8 Drawing Figures

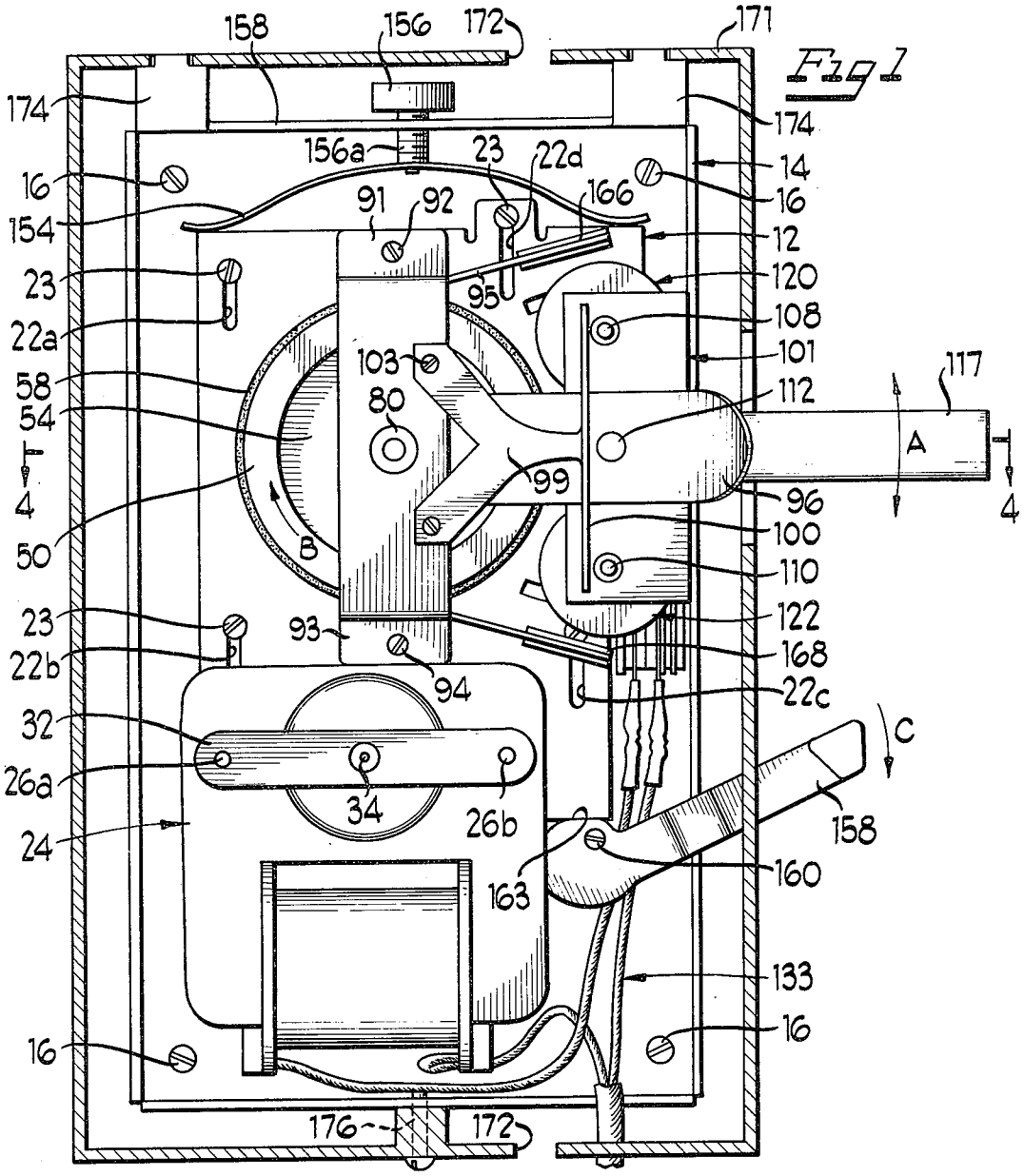
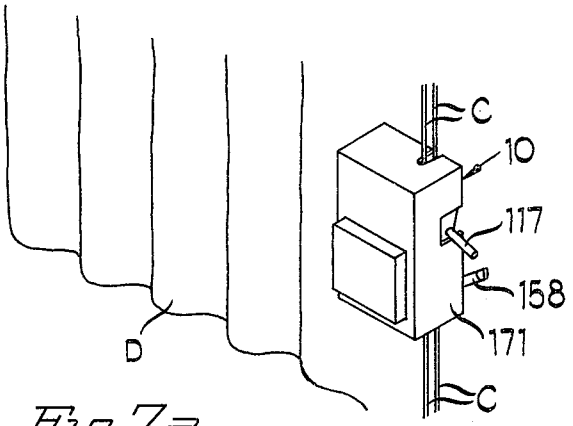
Fig 7a
Fig 7b
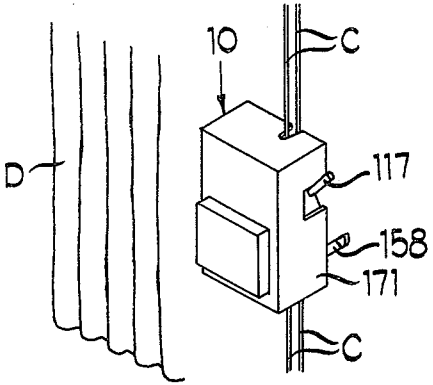

Fig 4
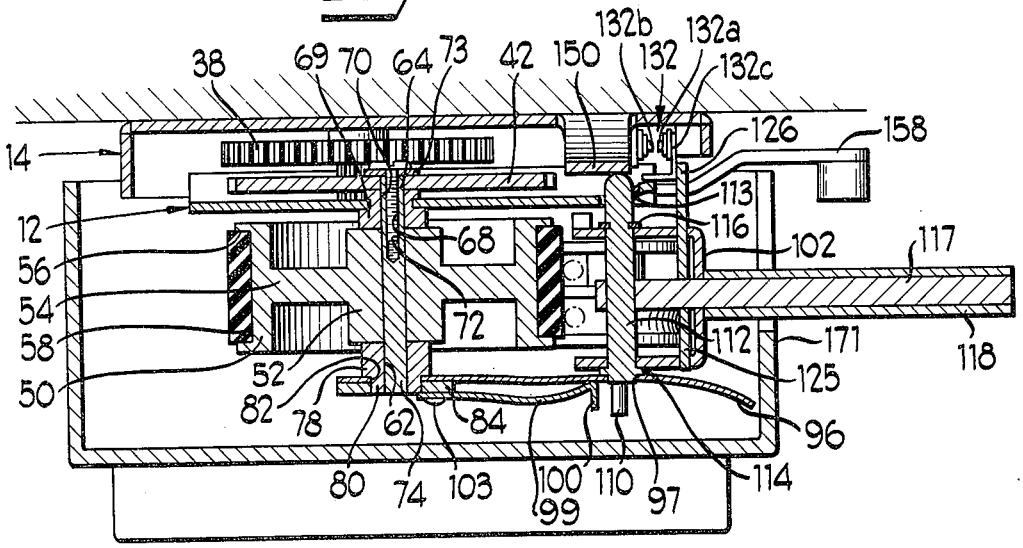
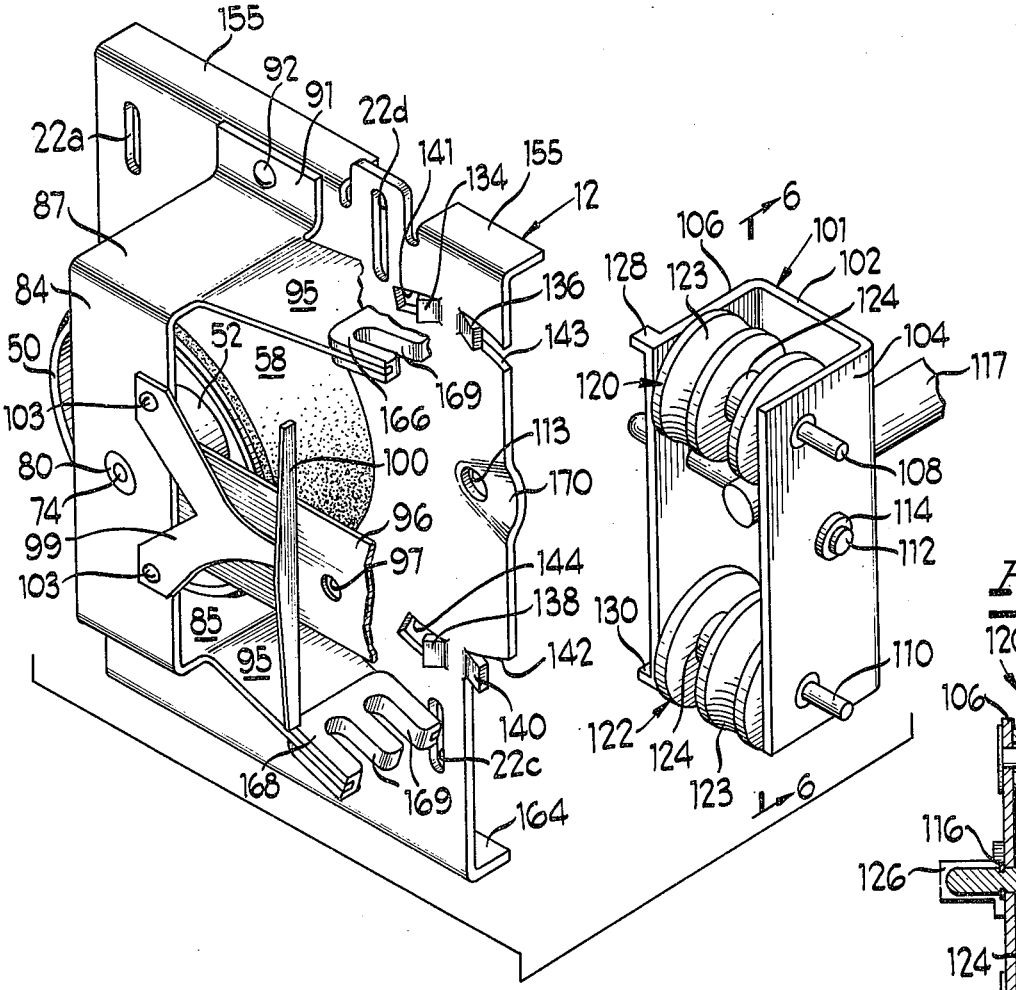
Fig 5
Fig 6
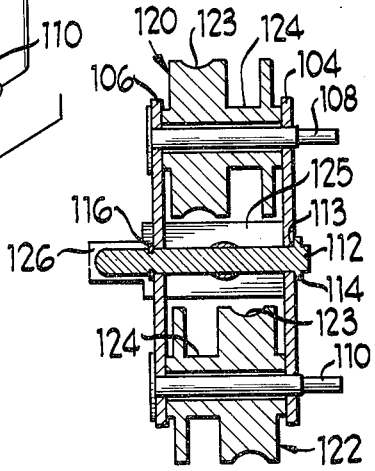

DEVICE FOR OPENING AND CLOSING OF CORD OPERATED CLOSURES

BACKGROUND AND SUMMARY OF THE INVENTION

This invention relates to an opening and closing device for cord operated closures and particularly to one utilizing a unidirectional motor. Most prior devices required a bi-directional motor to cause the cord to be driven in opposite directions. In one instance, as shown in U.S. Pat. No. 2,468,453, a unidirectional motor is used, but the entire motor is pivotally mounted and moved by solenoids to change the motor shaft engagement with the cord operating mechanism for changing closure direction.

In most instances where an automatic shutoff is used, switches are provided which had to be actuated by mechanisms attached directly to the cord. The current invention moves the cords for the closure device by means of a pair of idler pulleys mounted on a pivotal pulley housing which is used to manually move the idler pulleys into and out of engagement with a frictional drive roller, with the closure cords pinched therebetween, one idler pulley moving one cord in one direction and the other idler pulley moving the other cord in the opposite direction. The frictional drive roller is unidirectionally driven by a unidirectional motor.

The two cord engaging idler pulleys are designed to permit each pulley to pivot toward both cords of the closure mechanism but to drive only one cord at a time. The idler pulleys are formed in two sections, one section to engage the cord, the other section to guide the other cord. The idler pulleys are mounted within a common pivotal housing such that the idler pulley which engages which cord is determined by the direction of pivoting the housing.

The device includes an automatic shutoff in the form of a tension responsive release means. When the driven cord has caused the closure to travel the full extent of its capability, the tension in the cord is effective to operate the shutoff and release the cord. In the exemplary embodiment, the drive mechanism is slidably mounted upon a frame such that tension in the cord will cause the drive mechanism to slide upon the frame and engage a release cam to move the pulley housing and both of the idler pulleys mounted thereon, thereby releasing the cord. Return springs return the mechanism to the initial released position.

Additionally, the device incorporates a manual release device to enable the user to stop the closure movement at any time before the closure reaches the end of its travel. The manual release device is a levered cam to engage and slidably move the drive mechanism upon the frame to then engage the automatic release cam discussed above.

Other objects, features and advantages of the invention will be apparent from the following detailed description taken in connection with the accompanying drawings.

BRIEF DESCRIPTION OF THE DRAWINGS

FIG. 1 is a front elevational view of the present described invention, with the cover plate in section to illustrate the internal components of the device;

FIG. 4 is a horizontal section taken generally along the line 4—4 of FIG. 1;

FIG. 5 is an exploded, fragmentary perspective view of certain of the drive components and the pulley housing, with the pulley housing at the right of the figure turned 90° for clarity;

FIG. 6 is a vertical section of the pulley housing taken generally along line 6—6 of FIG. 5; and FIGS. 7*a* and 7*b* are perspective views, on a reduced scale, of the invention in a functional setting.

DESCRIPTION OF THE PREFERRED EMBODIMENT

Figure 2:
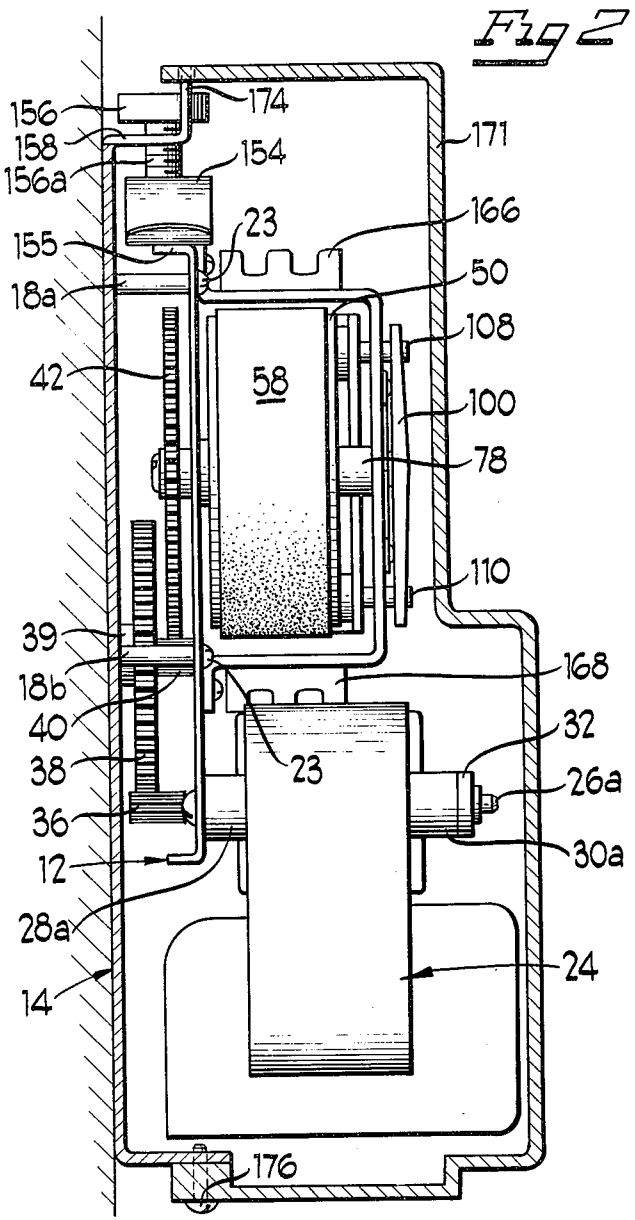
FIG. 2 is a left side elevational view, as viewed in FIG. 1, with the cover plate in section.

Referring to FIG. 1, the invention, generally designated 10, includes a reset plate, generally designated 12, slidably mounted upon a wall mounting plate, generally designated 14. The wall mounting plate 14 is generally rectangular in shape and is mounted to a wall or other support surface by a plurality of screws 16 through appropriate apertures therethrough. Referring to FIG. 2, wall mounting plate 14 has four tubular support posts 18*a*, 18*b*, 18*c* (not shown) and 18*d* (not shown) mounted thereon and extending outwardly therefrom. The posts 18 each have a circular, centrally located, threaded axial hole.

Referring again to FIG. 1, the reset plate 12 has four vertical elongated slot holes 22*a*, 22*b*, 22*c* and 22*d*. Four screws 23 slidably mount the reset plate 12 upon the support plate 14 with the shanks of the screws extending through the elongated holes 22 screwed into posts 18 with the heads thereof slidably retaining the reset plate 12 to the wall mounting plate 14. The screws are tightened into posts 18 to bottom out therein but the heads of the screws are sufficiently spaced from the ends of the posts so as not to interfere with the vertical movement of the reset plate.

Figure 3:
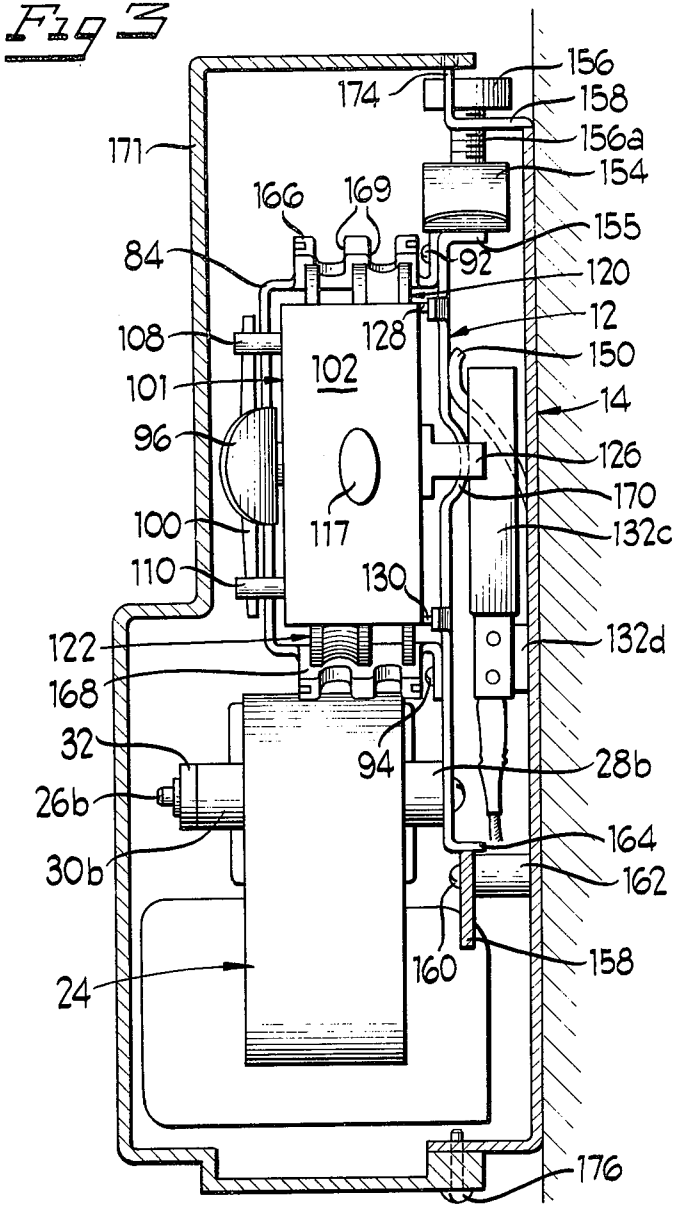
FIG. 3 is a right side elevational view, as viewed in FIG. 1, with the cover plate in section.

Mounted upon the reset plate 12 is a motive means in the form of a unidirectional motor, in particular a shaded pole electric motor, generally designated 24. As shown in FIG. 3, the motor 24 is rigidly held to the reset plate 12 by screws 26*a* and 26*b* which extend through apertures in the reset plate through cylindrical spacers with concentric axial clearance holes 28*a* and 28*b* through apertures within the body of motor 24, through cylindrical spacers with concentric axial holes 30*a* and 30*b*, and are screwed into two circular tapped holes within a motor mounting bracket 32.

A motor shaft 34 extends horizontally from motor 24 inwardly towards the reset plate 12. A pinion gear 36 is mounted upon the shaft 34. The pinion gear 36 is meshed with a larger disc gear 38, the gear 38 being rotatably mounted to the reset plate 12 by a spacer 39. A pinion gear 40 is concentrically mounted to the disc gear 38 and is in mesh with a larger disc gear 42.

Referring to FIG. 4, a frictional drive means partially comprises a circular roller 50. A hub 52 is centrally interiorly disposed within roller 50. A web 54 rigidly radially couples the hub 52 to the roller 50. A wide groove 56 extends the entire periphery of the roller 50 and is interiorly disposed from the axial edges. Securely embedded within the groove 56 is a band of material 58 fabricated of a resilient material which is textured on its exterior outer surface for improved frictional characteristics.

An axial circular hole 62 is disposed centrally within the hub 52. A shaft 63 is located within the hole 62, extending axially outward in both directions from the roller 50. One end 64 of the shaft 63 contains a concentric axially tapped hole 68 for receiving a screw therein. A bearing 69 is captively held within an aperture in the reset plate 12. The shaft end 64 is rotatably mounted within and extends through an axial centrally located hole 70 of the bearing 69. The gear 42 is rigidly mounted to the shaft end 64 by a screw 72 screwed into the tapped hole 68. A washer 73 is interdisposed between the head of the screw 72 and the gear 42. The other end 74 of the shaft extends axially outwardly from the hub 52, oppositely disposed from shaft end 64.

A bearing 76 has a first portion 78 in the form of a wide circular flange having a concentric axial hole. A second portion 80 of the bearing, in the form of a cylindrical narrow neck is rigidly held in an aperture 82 within a bracket 84.

Referring to FIG. 5, the bracket 84 is U-shaped and has two legs 85 and 87. Legs 85 and 87 have outwardly extending right angle tabs 91 and 93 which are rigidly secured to the reset plate 12 by screws 92 and 94. The shaft portion 74 extends through the bearing portions 78 and 80 and is rotatably mounted within their common axial hole. The mounting of shaft 63 by the bearings 69 and 78 thereby captivates the shaft 56 and the roller 54 in the vertical and horizontal planes, permitting rotational movement thereof. A pair of flanges, generally designated 95, extend horizontally outwardly from bracket legs 85 and 87 with cord guide openings and will be discussed in greater detail hereinafter.

Referring to FIG. 4, a retainer spring 96 is fabricated of resilient material and is rigidly mounted at one end by neck 80 passing through an aperture therein, and flange 78 bearing against bracket 84 with spring 96 therebetween. Disposed in spring 96 is an aperture 97. The other end of spring 96 is generally rounded and flares slightly away from the reset plate 12.

Referring to FIG. 5, a Y-shaped repositioning spring 99 is mounted upon the outside of bracket 84, the legs of the Y being retained to bracket 84 by screws 103. The stem of the Y-shaped spring terminates in a 90° vertically elongated flange 100 disposed outwardly away from and perpendicular to the reset plate 12 and of a length approximately equal to the diameter of the roller 50.

Again referring to FIG. 5, a pulley housing, generally designated 101, is in the form of a U-shaped bracket having a generally rectangular central portion 102 and two right angle generally rectangular legs 104 and 106. The two shafts 108 and 110 are captively mounted one directly above the other between legs 104 and 106 by force fit through appropriate apertures in the respective legs. The shafts are parallel to the bracket central portion and to each other, with one end of the shafts 108 and 110 extending outwardly away from the leg 104.

A central pivoting axle 112 is mounted between the legs 104 and 106, through circular holes therein. The axle 112 has a circular flange 114 (FIG. 6) disposed inwardly from the end outside of the bracket leg 104 forming a shoulder 113. The other end of the axle 112 is generally rounded in shape, passes through and extends past the bracket leg 106 and is retained by a C-shaped washer 116 disposed against the outside of bracket leg 106 within a groove cut in the axle. A handle 117 passes through an aperture within the central portion 102 of the bracket. The axle 112 extends through a transverse hole located in the inner end of the handle 117. A plastic sleeve 118 circumferentially surrounds the handle 117 for most of its length.

Two closure cord idler pulleys 120 and 122 are rotatably mounted within the housing 101 by shafts 108 and 110 press fit in the bracket legs 104. The idler pulleys are rotatable on their respective shafts and each idler pulley has two axial portions. The first portion comprises a shallow groove 123 of a depth less than the thickness or diameter of the cord or flexible strand which is connected to the closure device. The second portion of the idler pulleys 120 and 122 comprise a larger cutaway groove 124 for positionally guiding the cord or flexible strand while passing through the housing 101. The two pulleys 120 and 122 are mounted upon the shafts 108 and 110 in a complementary manner such that a cord passing through the housing 101 will pass through the cutout portion 124 of one of the pulleys while being gripped or pinched by the portion 123 of the other pulley when that pulley is positioned to engage the frictional drive roller 50, as will be discussed hereinafter.

Referring to FIG. 4, the rounded end of the pulley bracket pivoting axle 112 passes through an aperture 113 within the reset plate 12. The spring 96 bears against the flange 114 (FIG. 6) of the axle 112. A flat generally rectangular switch actuating member 125 passes through and between the bracket legs 104 and 106 through generally rectangular slots therein, adjacent the inside of the central bracket leg 102. The switch actuating member 125 has a hole approximately centrally thereof for handle 117 to pass therethrough. A generally rectangular tongue 126 (FIG. 6) extends from the actuating member 125 toward the reset plate 12 in close proximity to an electrical switch, generally designated 132 in FIG. 4. The electrical switch 132 is mounted to the wall mounting plate 14, and is electrically connected by appropriate wiring means, generally designated 133 in FIG. 1, to an external AC power source and to the motor 24 to activate the motor 24. When the device 10 is in the disengage or release mode of FIG. 1, with the handle 117 centrally disposed, switch contacts 132 are in the normally open position. When the handle is pivoted in either direction, as indicated by the double headed arrow A in FIG. 1, the tongue 126 likewise will move in an arcuate path to urge a movable contact 132*a* against a fixed contact 132*b* (FIG. 4) of switch 132. The movable contact 132*a* is mounted on a flexible leaf spring 132*c* of the switch, the latter being mounted by appropriate bracket means 132*d* to the wall mounting plate 14.

Latch means is provided to hold the pulley bracket in either of its operative positions with one or the other of the pulleys biased against the frictional drive roller 50. This means includes two small horizontal generally rectangular flat tabs 128 and 130 (FIG. 5) disposed at the top and bottom corners of the bracket leg 106 extending towards the reset plate 12. In the inoperative mode shown in FIG. 1, the upper bracket tab 128 rests between a pair of canted ramp-like tabs 134 and 136 formed from the reset plate 12, as shown best in FIG. 5, such that tab 134 and tab 136 form a saddle rest position for upper bracket tab 128. In a similar manner, lower ramp-like angled tabs 138 and 140 are formed from the reset plate 12 to form a saddle rest position for the lower bracket tab 130. The spring 96 bears against the flange 114 of shaft 112 which, in turn bears against the pulley bracket to hold the bracket tabs in position between their respective reset plate tabs.

As stated above, the pulleys 120 and 122 are engaged by the manual application of force upwardly or downwardly in the vertical plane to the handle 117 as shown by arrow A in FIG. 1. This force is transmitted by the handle 117 pivoting about pivoting axle 112 to the pulley bracket 101, causing the bracket 101 also to pivot about the axle 112. This pivoting action coincidentally causes a number of things to happen. First, depending upon the direction of pivot, either of the pulleys 120 and 122 are brought into rollable forceful contact with the friction drive roller 50. One of the closure cords C (see FIG. 7) is engaged, determined by the direction of pivot of the handle 117. If the pulley 120 is engaged, the first cord passing through portion 123 thereof is acted upon by pulling down on the cord (with the drive roller rotating in a clockwise direction as viewed in FIGS. 1 and 5) and the second cord passing through portion 125 thereof is not acted upon. Similarly, if the pulley 122 is engaged, the action on the cords is interchanged. Secondly, the upper bracket tab 128 is forced to ride up one of the tabs 134 or 136, and the lower bracket tab 130 is forced to ride up one of the tabs 138 or 140, until the bracket tabs are forced past one of the reset plate tabs, towards the reset plate 12, to fall into one of a plurality of generally rectangular holes 141 and 142, or 143 and 144 in the reset plate by the action of spring 96 biasing against the pivoting axle 112, where the pulley bracket is then held in one of its alternate operative positions. Thirdly, one of the pulley shafts 108 or 110 is pivoted to engage the repositioning spring portion 100 to store energy in the spring for returning the pulley bracket 101 to its inoperative position. Lastly, the switch actuating tongue 126 is pivoted to actuate the switch, as described above, connecting motor 24 to the power source.

When the motor 24 is electrically activated, shaft 34 of the motor 24 is caused to rotate. This rotational drive is transmitted through the gears 36, 38, 40 and 42 to the friction drive roller 50, causing the friction drive roller 50 to rotate in the direction of arrow B shown in FIG. 1. As described in the first of the coincident actions, either of the pulleys 120 or 122, depending upon the direction of pivoting, are brought into forceful rotational engagement with roller 50 and, if there is a cord placed therebetween, the cord will be pinched between either one of the pulleys 120 or 122 and the drive roller 50, causing the cord to be pulled by the engagement groove portion 123 of the appropriate pulley. If the cord is attached to a closure device, D in FIG. 7, the closure device will be activated to operate in either an opening or closing manner, the direction of closure being determined by the cord arrangement and external mechanism. It can be seen that, after engagement and subsequent disengagement, pivoting in the opposite direction will cause the other of the cords to be driven and the direction of operation of the closure will be reversed.

Once the device is engaged and locked in one of the operative positions described above, release or shutoff can be accomplished either automatically or manually. Referring to FIG. 3, a release cam 150 is attached to the wall mounting plate 14 extending angularly upwardly towards the reset plate 12. Referring to FIG. 1, an arcuate spring 154 contacts the top of the reset plate 12 along a flange 155 at its uppermost edge. A thumbscrew 156 is screwed into an aperture in a flange 158 of the wall mounting plate 14, as shown in FIG. 3. The flat end of the threaded shank portion **156*a* of the thumbscrew 156 is secured to the central uppermost portion of spring 154**.

For automatic shutoff, the drive roller 50, in conjunction with one or the other of the pulleys 120 or 122 pinching a closure cord therebetween, is capable of driving the cord the limit of its travel. At the end of cord travel, with the drive roller 50 continuing to rotate, tension will develop in the cord causing the cord to pull on the reset plate whereupon the reset plate and all of the components fixed thereto travel up the cord. This is permitted by the aforesaid vertical slidable mounting between the reset plate and the wall mounting plate, as described above (i.e., slots **22*a*–22*d*, etc.). The roller 50 and one of the pulleys 120 or 122 will tend to rollably ride upwardly upon the cord irrespective of the previous closure direction of movement since the drive mechanism always urges a cord in the same downward direction. As the reset plate 12 travels up the cord against the counterforce provided by spring 154, release cam 150 will engage and bear against the rounded interiorly depending end of the axle 112, as shown in FIG. 4. The axle 112 is horizontally and axially captively held to the pulley bracket 101 by the C-washer 116 and the flange 116. Upon the engagement thereof, the axle 112 is moved horizontally outwardly away from the reset plate 12 against the force of the retaining spring 96, whereby the tabs 128 and 130 are forced away from the reset plate 12 out of the holes 141, 142, 143 and 144, past the ramp-like tabs 134, 136, 138 and 140 permitting the pulley bracket 101 to return to the inoperative position. The spring tab 100, which was deformed by the rotational force of shaft 108 or 110, then restores itself to a generally vertical position and additionally pivots the pulley bracket 101 about the axle 112 into the inoperative position causing disengagement of one of the pulleys 120 or 122 from the drive roller 50. Consequently, the cord is released, the motor is shut off and the spring 154 pushes reset plate 12** back downwardly to its original position.

The thumbscrew 156 can be used to adjust the amount of tension on the spring 154 to adjust the amount of back tension necessary to be provided by the roller 50 on the cord thereby initiating the automatic release mode. Too much tension may break the cord and too little tension may cause premature automatic shutoff.

The manual means to selectively shut off the device includes a manual reset or shutoff lever 158 which is rotatably secured at a rounded end thereof to the wall mounting plate 14 by a screw 160 threaded in an aperture in a post 162 extending away from the wall mounting plate 14 (see FIGS. 1 and 3). The rounded end of the lever 158 forms a cam surface 163 which, when pivoted about the screw 160, engages a lip 164 extending along the bottom edge of the reset plate 12. When the lever 158 is rotatably moved in the direction of arrow C in FIG. 1, the cam surface 163 of the lever 158 bears against the underside of the lip 164 pushing the reset plate 12 upwardly a sufficient distance to cause release cam 150 to engage axle 112, as previously described for automatic operation, thereby causing the release action to be manually initiated.

The pulley bracket 101 is removable by outward manual movement of the spring 96 to permit the release of pressure against axle 112 thereby enabling the pulley bracket 101, pulleys, handle 117, etc., to be removed for cord positioning therein. The cords can be positioned within the device extending through guide flanges 166 and 168 (FIG. 5) and appropriate elongated slotted notches 169. The flanges are part of the drive roller bracket 84. Upon proper positioning of the cords, the pulley bracket 101 is then repositioned such that the rounded edge of the axle 112 will be guided into the hole 113 by a recessed dimple 170 shown in FIG. 5.

A cover 171 encloses the mechanism with apertures 172 (FIG. 1) permitting cord passage therethrough. The cover is held to wall mounting plate 14 by tabs 174 (FIGS. 1–3) extending upwardly from the wall mounting plate through appropriate apertures in the cover along with a lower retainer screw 176.

FIG. 7 shows the installed device in the functional mode of opening and closing drapes.

The foregoing detailed description has been given for clearness of understanding only and no unnecessary limitation should be understood therefrom as some modifications will be obvious to those skilled in the art.

We claim:

1. An opening and closing device for cord operated closures having a pair of cords or a pair of cord runs, one cord or cord run for opening the closure and the other cord or cord run for closing the closure, comprising:

a frame structure;

a unidirectional motor mounted on the frame structure, including drive means for engaging and longitudinally driving either one of said cords; and direction determining means for selective closing or opening of the closure, said direction determining means being movably mounted on said frame structure for engaging either one of said cords and bringing said cord into driving engagement with said drive means.

2. The device of claim 1 including means to deactivate said motor in response to a predetermined tension in a driven one of said cords.

3. The device of claim 1 including means to immobilize said direction determining means in response to a predetermined tension in a driven one of said cords.

4. The device of claim 1 wherein said direction determining means includes two portions alternately engageable with said pair of cords, one portion engaging one of the cords while the other is in an idler condition.

5. The device of claim 1 wherein said drive means comprises a frictional drive roller.

6. The device of claim 5 wherein said direction determining means includes two portions alternately engageable with said pair of cords, one portion engaging one of the cords while the other is in an idler condition.

7. The device of claim 6 wherein said portions of said direction determining means comprise a pair of pulleys alternately movable toward said drive roller to sandwich the respective cord therebetween.

8. The device of claim 7 including means for holding either of said pulleys in driving position with said drive roller after movement thereto.

9. The device of claim 7 wherein said pulleys are mounted by means for moving one of the pulleys toward the drive roller while moving the other pulley away from the drive roller.

10. The device of claim 9 wherein said mounting means for the pulleys comprises a common lever structure.

11. The device of claim 10 wherein said lever structure has a protruding handle for manual pivoting thereof.

12. An actuator for opening and closing draperies or the like operated by a pair of cord runs, comprising:

a frame structure;

a unidirectional motor mounted on the frame structure; and selectively operable direction determining drive means for selective closing or opening of the drapery, said drive means being movably mounted on said frame structure and including a pair of pulleys mounted on generally parallel axes in alignment with said cord runs for alternately engaging and longitudinally driving either one of said cord runs.

13. An opening and closing device for cord operated closures having a pair of cords or a pair of cord runs, one cord or cord run for opening the closure and the other cord or cord run for closing the closure, comprising:

a frame structure;

a unidirectional motor mounted on the frame structure including a friction drive roller for engaging and longitudinally driving either one of said cords; and direction determining means movably mounted on said frame structure including two pulleys in alignment on generally parallel axes alternately movable toward said drive roller to sandwich one of the cords therebetween for selective closing or opening of the closure.

14. An opening and closing device for cord operated closures having a pair of cords or a pair of cord runs, one cord or cord run for opening the closure and the other cord or cord run for closing the closure, comprising:

a frame structure;

a unidirectional motor mounted on the frame including drive means for engaging and longitudinally driving either one of said cords;

direction determining means movably mounted on said frame structure for engaging either one of said cords and bringing said cord into driving engagement with said drive means; and means to immobilize said direction determining means in response to a predetermined tension in one of said cords, including a support plate for mounting the frame structure for movement relative thereto in the longitudinal direction of at least one of said cords in response to a predetermined tension in said cord.

15. An opening and closing device for cord operated closures having a pair of cords or a pair of cord runs, one cord or cord run for opening the closure and the other cord or cord run for closing the closure, comprising:

a frame structure;

motive means mounted on the frame structure, including drive means for engaging and driving at least one of said cords;

means for deactivating said motive means in response to a predetermined tension in the driven cord; and a support plate for said frame structure, said frame structure being mounted on said support plate for movement relative thereto in the longitudinal direction of the driven cord in response to said predetermined tension in the driven cord, and said means for deactivating said motive means being responsive to said movement of the frame structure.

16. The device of claim 15 including switch means closable to activate said motive means and openable in response to said movement of the frame structure.

17. An opening and closing device for cord operated closures having a pair of cords or a pair of cord runs, one cord or cord run for opening the closure and the other cord or cord run for closing the closure, comprising:

a frame structure;

a unidirectional motor mounted on the frame structure, including drive means having a frictional drive roller for engaging and longitudinally driving either one of said cords;

direction determining means including two pulleys alternately engageable with one of said pair of cords and the drive roller to sandwich the respective cord therebetween and means for holding either of said pulleys in engagement therewith; and a support plate mounting said frame structure for movement relative thereto in the longitudinal direction of at least one of said cords in response to a predetermined tension in said cord and means to release said holding means in response to movement of the frame structure.

18. The device of claim 17 including means to deactivate said motor means in response to said movement of the frame structure.

19. An opening and closing device for cord operated closures having a pair of cords or a pair of cord runs, one cord or cord runner for opening the closure and the other cord or cord runner for closing the closure, comprising:

a frame structure;

a unidirectional motor mounted on the frame structure including drive means for engaging and longitudinally driving either one of said cords;

direction determining means movably mounted on said frame structure for engaging either one of said cords and bringing said cord into driving engagement with said drive means; and means to deactivate said motor in response to a predetermined tension in one of said cords, including a support plate for said frame structure, said frame structure being mounted on said support plate for movement relative thereto in the longitudinal direction of at least one of said cords in response to a predetermined tension in said cord.

20. The device of claim 19 including means to immobilize said direction determining means in response to said movement of the frame structure.

* * * * *